US007921919B2

(12) United States Patent
Horton, III

(10) Patent No.: US 7,921,919 B2
(45) Date of Patent: Apr. 12, 2011

(54) SUBSEA WELL CONTROL SYSTEM AND METHOD

(75) Inventor: Edward E. Horton, III, Houston, TX (US)

(73) Assignee: Horton Technologies, LLC, Houston, TX (US)

( * ) Notice: Subject to any disclaimer, the term of this patent is extended or adjusted under 35 U.S.C. 154(b) by 1022 days.

(21) Appl. No.: 11/739,157

(22) Filed: Apr. 24, 2007

(65) Prior Publication Data

US 2008/0264642 A1 Oct. 30, 2008

(51) Int. Cl.
*E21B 29/12* (2006.01)

(52) U.S. Cl. ..... 166/366; 166/368; 166/367; 166/350; 405/224.2

(58) Field of Classification Search ..... 166/366, 166/368, 360, 350–355, 367; 405/224.2–224.4
See application file for complete search history.

(56) References Cited

U.S. PATENT DOCUMENTS

| | | | | | |
|---|---|---|---|---|---|
| 3,111,692 | A | * | 11/1963 | Cox | 114/264 |
| 3,261,398 | A | * | 7/1966 | Haeber | 166/352 |
| 3,444,927 | A | * | 5/1969 | Childers et al. | 166/351 |
| 3,504,740 | A | * | 4/1970 | Manning | 166/339 |
| 3,517,735 | A | * | 6/1970 | Fairbanks et al. | 166/366 |
| 3,590,919 | A | * | 7/1971 | Talley, Jr. | 166/357 |
| 3,602,302 | A | * | 8/1971 | Kluth | 166/336 |
| 3,643,736 | A | * | 2/1972 | Talley, Jr. | 166/356 |
| 4,027,286 | A | * | 5/1977 | Marosko | 340/825.73 |
| 4,052,703 | A | | 10/1977 | Collins et al. | |
| 4,174,000 | A | | 11/1979 | Milberger | |
| 4,211,281 | A | * | 7/1980 | Lawson | 166/345 |
| 4,265,313 | A | * | 5/1981 | Arnaudeau | 166/366 |
| 4,371,037 | A | * | 2/1983 | Arnaudeau | 166/366 |
| 4,378,848 | A | | 4/1983 | Milberger | |
| 4,848,474 | A | * | 7/1989 | Parizot et al. | 166/366 |
| 5,040,607 | A | * | 8/1991 | Cordeiro et al. | 166/366 |

(Continued)

FOREIGN PATENT DOCUMENTS

EP 0026353 4/1981

(Continued)

OTHER PUBLICATIONS

International Search Report and Written Opinion dated Aug. 22, 2008 (11pages).

*Primary Examiner* — Thomas A Beach
(74) *Attorney, Agent, or Firm* — Conley Rose, P.C.

(57) ABSTRACT

A system comprising a surface installation in position above a plurality of subsea wells disposed within the watch circle of the surface installation. A plurality of flowlines directly couple at least one of the plurality of subsea wells to the surface installation. A control station, a hydraulic power unit, and an injection unit are disposed on the surface installation. A distribution body is disposed on the seafloor and is coupled to each of the control station, hydraulic power unit, and the injection unit via one or more umbilicals. A first wellhead component is disposed on one of the subsea wells and is coupled to the distribution body via one or more flying leads that provide electrical, hydraulic, and fluid communication. A second wellhead component is disposed on another one of the subsea wells and coupled to the distribution body via one or more flying leads that provide electrical, hydraulic, and fluid communication. The control station is operable to provide control functions to the first and second wellhead components during drilling, workover, and production activities.

20 Claims, 14 Drawing Sheets

U.S. PATENT DOCUMENTS 5,255,744 A * 10/1993 Silva ..... 166/347
5,256,844 A * 10/1993 Grosvik et al. ..... 219/629
5,295,547 A * 3/1994 Coelho et al. ..... 166/368
6,059,039 A * 5/2000 Bednar et al. ..... 166/344
6,102,124 A * 8/2000 Skeels et al. ..... 166/347
6,213,215 B1 * 4/2001 Breivik et al. ..... 166/350
6,230,810 B1 * 5/2001 Rivas ..... 166/357
6,263,971 B1 * 7/2001 Giannesini ..... 166/366
6,336,421 B1 * 1/2002 Fitzgerald et al. ..... 114/264
6,420,976 B1 * 7/2002 Baggs et al. ..... 340/853.3
6,470,970 B1 * 10/2002 Purkis et al. ..... 166/374
6,517,286 B1 * 2/2003 Latchem ..... 405/53
6,536,528 B1 * 3/2003 Amin et al. ..... 166/369
6,672,391 B2 1/2004 Anderson et al.
6,808,021 B2 10/2004 Zimmerman et al.
6,988,554 B2 * 1/2006 Bodine et al. ..... 166/363
7,093,661 B2 * 8/2006 Olsen ..... 166/357
7,108,069 B2 * 9/2006 Killie et al. ..... 166/336
7,137,451 B2 * 11/2006 Smith ..... 166/335
7,152,682 B2 * 12/2006 Hopper ..... 166/357
7,219,740 B2 * 5/2007 Saucier ..... 166/366
7,416,025 B2 * 8/2008 Bhat et al. ..... 166/355
2001/0013414 A1 * 8/2001 Fitzgerald et al. ..... 166/366
2002/0040783 A1 * 4/2002 Zimmerman et al. ..... 166/366
2004/0134662 A1 * 7/2004 Chitwood et al. ..... 166/367
2004/0149445 A1 * 8/2004 Appleford et al. ..... 166/357
2005/0178556 A1 * 8/2005 Appleford et al. ..... 166/366
2008/0093081 A1 * 4/2008 Stoisits et al. ..... 166/366

FOREIGN PATENT DOCUMENTS

GB 2059534 A * 4/1981

* cited by examiner

SUBSEA WELL CONTROL SYSTEM AND METHOD

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to the control and monitoring of the operation of subsea wells. More particularly, the present invention relates to a distributed system for the control and monitoring of a plurality of wells in a subsea field.

In practice, there are three types of wells to be controlled: production wells, wells that are being maintained ("work-over wells"), and drilling wells. Each is traditionally controlled from a surface platform by dedicated control equipment attached to a riser and a wellhead tree (in the production environment) or a blowout preventer (BOP) (in the drilling or work-over environment). Such dedicated control systems are expensive, heavy, and complex and, a dedicated system for each well is typical. Thus, there is a long-felt need to reduce the number of such control systems and to reduce the complexity of the risers that must be used with them.

In situations in which some wells are producing in an area near where other wells are being drilled or worked over, various types of vessels and control equipment are used. As described above, typically the control systems for the drilling operations are different from those for the production operation, and both are different from the work-over situation. Thus, there is a need to reduce the number and type of control and distribution systems in areas or fields in which production, drilling, and/or work-over operations are occurring in order to overcome some of the foregoing difficulties while providing more advantageous overall results.

SUMMARY OF THE INVENTION

Various of the above-described problems are addressed in the numerous aspects of the present invention, either alone or in combination.

A system comprising a surface installation in position above a plurality of subsea wells disposed within the watch circle of the surface installation. A plurality of flowlines directly couple at least one of the plurality of subsea wells to the surface installation. A control station, a hydraulic power unit, and an injection unit are disposed on the surface installation. A distribution body is disposed on the seafloor and is coupled to each of the control station, hydraulic power unit, and the injection unit via one or more umbilicals. A first wellhead component is disposed on one of the subsea wells and is coupled to the distribution body via one or more flying leads that provide electrical, hydraulic, and fluid communication. A second wellhead component is disposed on another one of the subsea wells and coupled to the distribution body via one or more flying leads that provide electrical, hydraulic, and fluid communication. The control station is operable to provide control functions to the first and second wellhead components during drilling, workover, and production activities.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
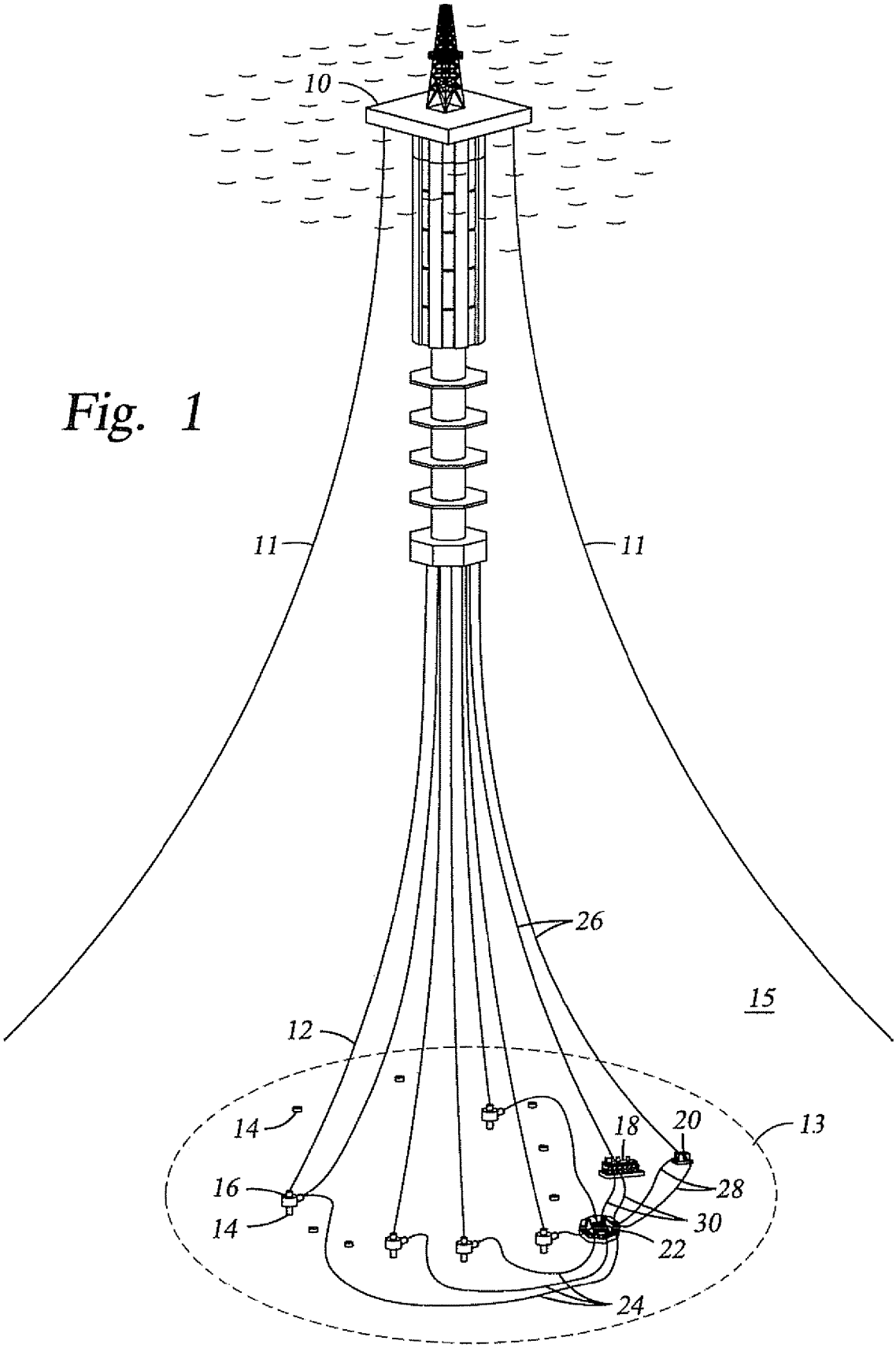
FIG. 1 illustrates a subsea field having a distributed control system constructed in accordance with embodiments of the present invention.

In the description that follows, like components are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Referring now to FIG. 1, floating platform 10 is positioned above a field of subsea wellheads 14. Floating platform 10 is secured on location by mooring system 11 that allows the platform to be positioned at any location within watch circle 13. Attached to some of subsea wellheads 14 are subsea trees 16. Also seen on bottom 15 is distribution control and monitoring station 22, which is coupled to subsea trees 16 by flying leads 24. Floating platform 10 is connected to subsea trees 16 through risers 12. Floating platform 10 performs distribution control and monitoring functions for subsea trees 16 through umbilicals 26 that terminate in subsea umbilical termination (SUT) assemblies including an electrical and hydraulic subsea umbilical termination assembly 18 and a chemical subsea umbilical termination assembly 20. The subsea umbilical termination assemblies 18 and 20 are connected to distribution control and monitoring station 22 through flying leads 28 and 30, respectively.

Figure 2:
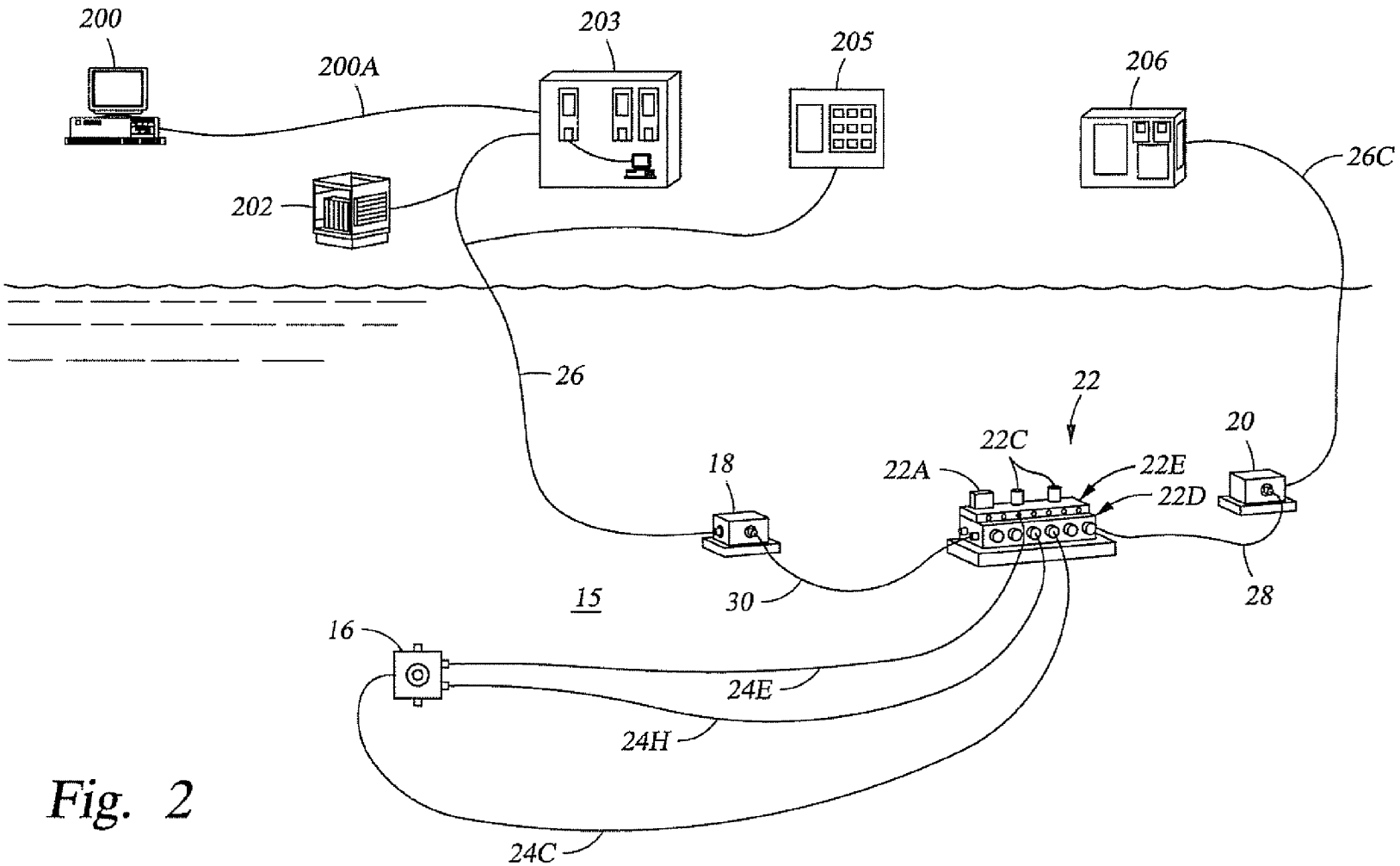
FIG. 2 is a partial schematic representation of a multiplexed electro-hydraulic subsea distributed control system constructed in accordance with embodiments of the present invention.

Referring now to FIG. 2, an electro-hydraulic multiplex control system for controlling subsea trees 16 from floating platform 10 (FIG. 1) is seen. Topside primary control station 200, hydraulic power unit 202, master control station 203, blowout preventer control system 205, and injection unit 206 are all disposed on floating platform 10. Topside primary control station (PCS) 200 communicates to master control station 203 through communications link 200A. Master control station 203 includes an electrical power unit (EPU) and an uninterruptible power supply (UPS). Master control station 203 and hydraulic power unit (HPU) 202 are coupled to electrical-hydraulic umbilical line 26 that terminates on sea floor 15 in electrical-hydraulic umbilical termination assembly 18, which is connected to distribution, control, and monitoring (DCM) station 22 through electrical-hydraulic flying lead 30.

Electrical-hydraulic flying lead 30 provides electric control signals and pressurized hydraulic fluid to DCM station 22, which comprises subsea distribution unit 22D and control unit 22E that includes control modules 22C and hydraulic accumulator package 22A. A variety of subsea control modules 22C and accumulator packages 22A that are alternative embodiments of the invention will occur to those of skill in the art without need for further description. Control unit 22E is connected to subsea tree 16 by electrical flying lead 24E that carries electrical signals between the control unit and the subsea tree. Distribution unit 22D is connected to subsea tree 16 by hydraulic control flying lead 24H that provides hydraulic communication between the distribution unit and the subsea tree.

Chemical injection unit 206 is connected through chemical umbilical 26C to chemical injection umbilical termination assembly 20 on bottom 15. Chemical injection umbilical termination assembly 20 is connected to subsea distribution unit 22D by chemical flying lead 28. Chemical injection is provided to subsea tree 16 by flying lead 24C.

Also seen in FIG. 2 is a BOP (blowout preventer) control system 205 that resides on floating platform 10 and is connected to electrical-hydraulic umbilical 26. Various BOP control systems 205 will occur to those of skill in the art, as will various chemical injection units 206, all of which are example embodiments of the invention and require no further explanation. Likewise, flying leads 28, 30, 24C, 24E, and 24H, will be understood by those with skill in the art without further elaboration, and installation of such flying leads between the termination assemblies 18 and 20, and subsea distribution unit 22, will also be understood by those of skill in the arts to be accomplished in various example embodiments of the invention by using a remote operated vehicle (ROV—not shown). Likewise, the connections of flying leads 24C, 24E, and 24H, between subsea distribution unit 22 and subsea tree 16 are accomplished in various example embodiments of the invention through the use of an ROV.

Figure 3:
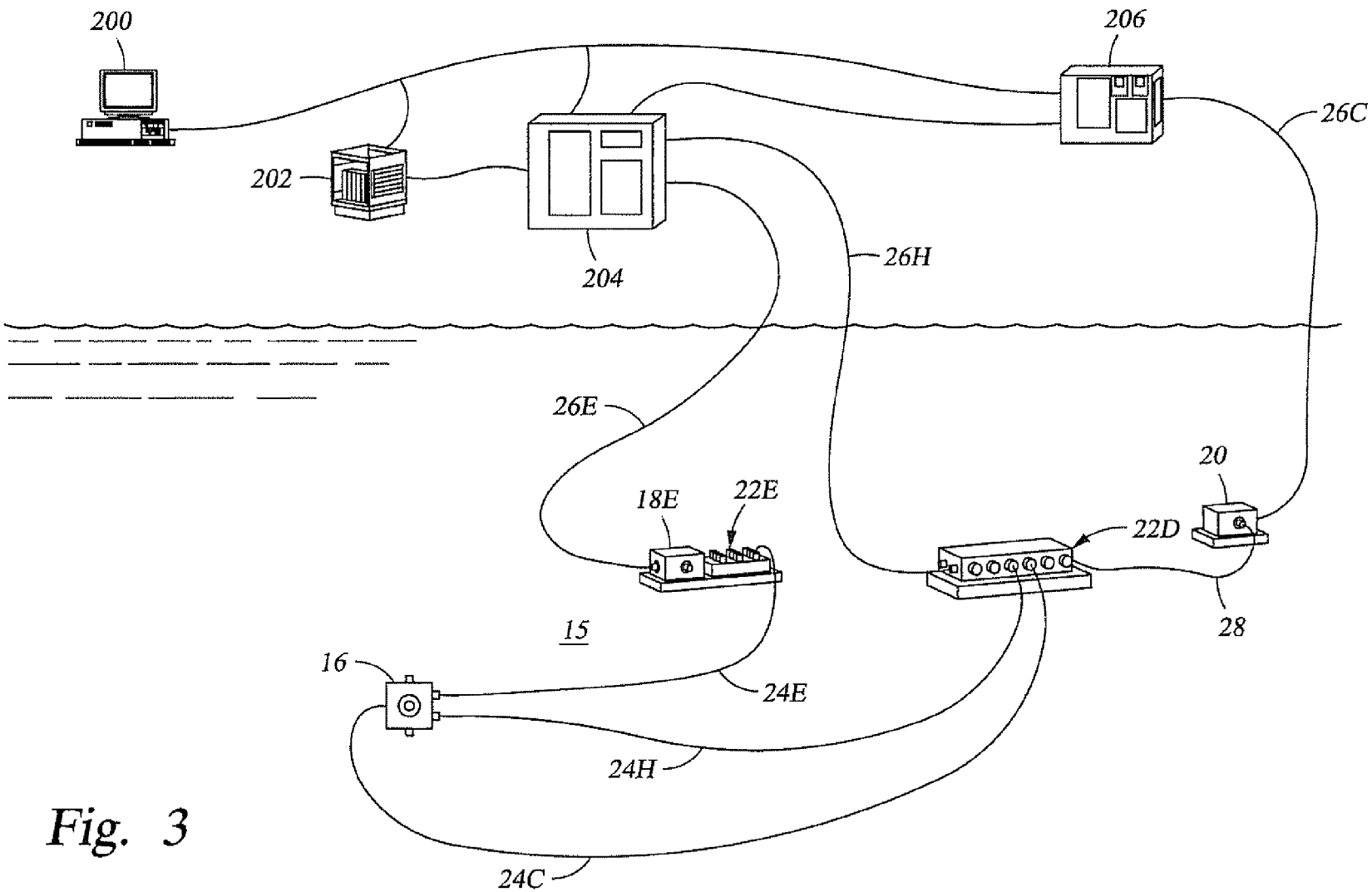
FIG. 3 is a partial schematic representation of a separated electro-hydraulic subsea distributed control system constructed in accordance with embodiments of the present invention.

Referring now to FIG. 3, an alternative embodiment is seen in which topside PCS 200 is connected to hydraulic power unit 202, well control panel 204, and chemical injection unit 206. Hydraulic power unit 202 and chemical injection unit 206 are also connected to well control panel 204. Thus, well control panel 204 controls, from floating platform 10, subsea trees 16 on bottom 15. Such control is accomplished through electrical umbilical 26E and hydraulic umbilical 26H. Electrical umbilical 26E is connected to electrical subsea umbilical termination assembly 18E and control unit 22E, as shown. Likewise, hydraulic umbilical 26H is connected to distribution unit 22D. Well control panel 204 communicates with chemical injection unit 206, which is connected to chemical injection umbilical 26C for umbilical communication with chemical injection umbilical termination assembly 20. The subsea distribution unit 22 is connected to the chemical injection umbilical termination assembly 20 via chemical injection flying lead 28. Subsea distribution unit 22D provides hydraulic communication to subsea tree 16 through hydraulic flying lead 24H and chemical injection communication to subsea tree 16 through flying lead 24C. Control 22E provides electrical communication to subsea tree 16 through flying lead 24E.

Although not shown in FIGS. 2 and 3, it will be understood by those of skill in the art that multiple wells 16 are controlled, as seen in FIG. 1, through a single set of distribution control and monitoring components. Thus, the need for a single umbilical to each subsea tree 16 is eliminated and multiple wells are controlled, monitored, or have fluids distributed to them through single umbilicals 26E, 26H, and 26C. At the same time, simplified risers 12 (FIG. 1) connect in a substantially vertical manner to subsea trees 16, allowing for insertion and removal of various tools useful in drilling, production, and work-over. Such insertion and removal of tools is not possible in systems in which production occurs through conduits that communicate to a central distribution control or monitoring station on the sea-floor, due to the acute angle between the well bore and the fluid conduit.

Figure 4:
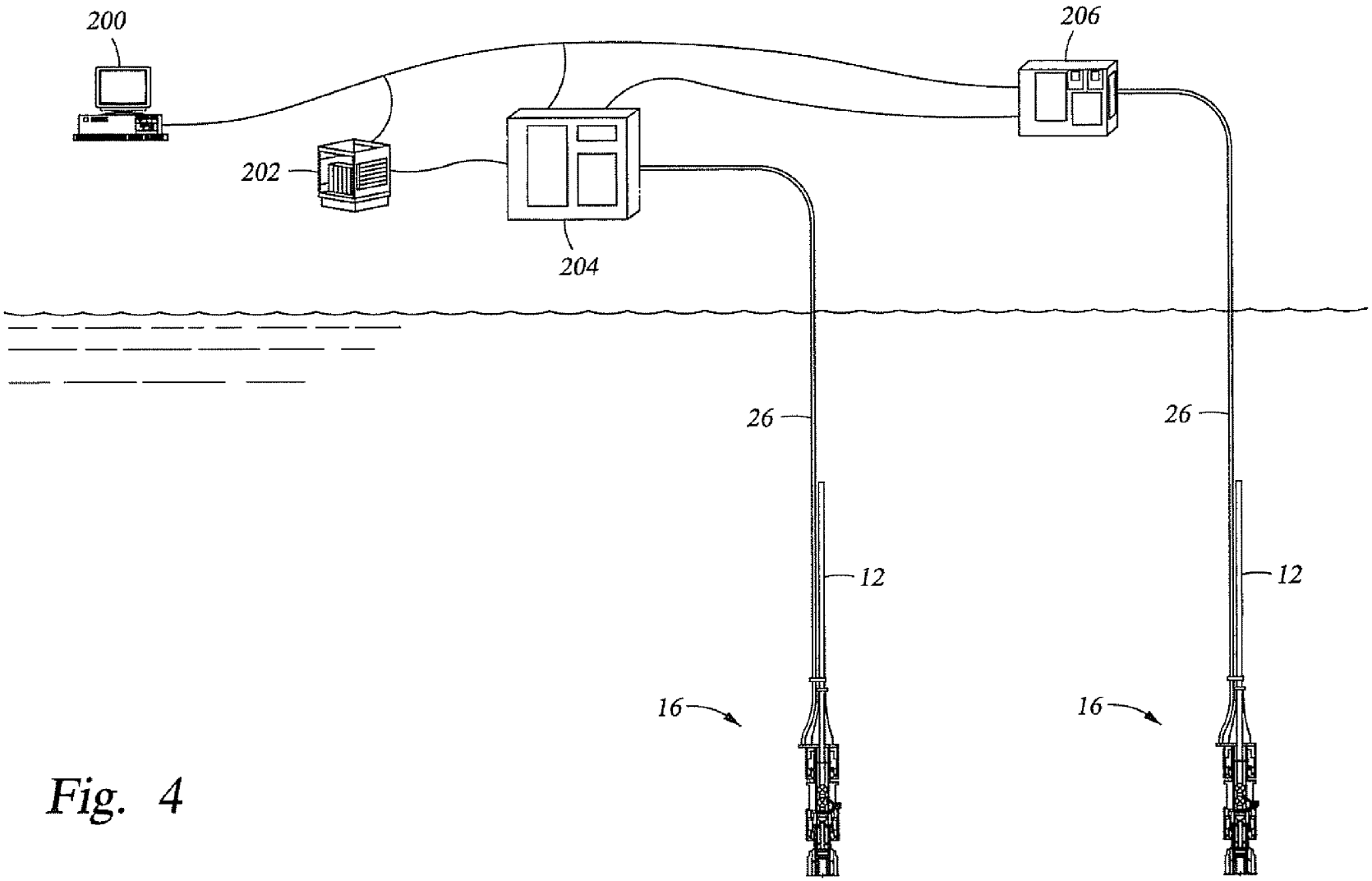
FIG. 4 is a partial schematic representation of an electro-hydraulic subsea direct control system constructed in accordance with embodiments of the present invention.

Referring now to FIG. 4, still another embodiment of well control is seen in which direct control to each well is accomplished. In the FIG. 4 embodiment, PCS 200 communicates with chemical injection unit 206, hydraulic power unit 202, and well control panel 204. In the illustrated embodiment, a single umbilical 26 is used for all electrical, hydraulic, and chemical injection functions and is separate from riser 12. Riser 12 and umbilical 26 are connected directly to subsea trees 16, as shown.

Figure 5:
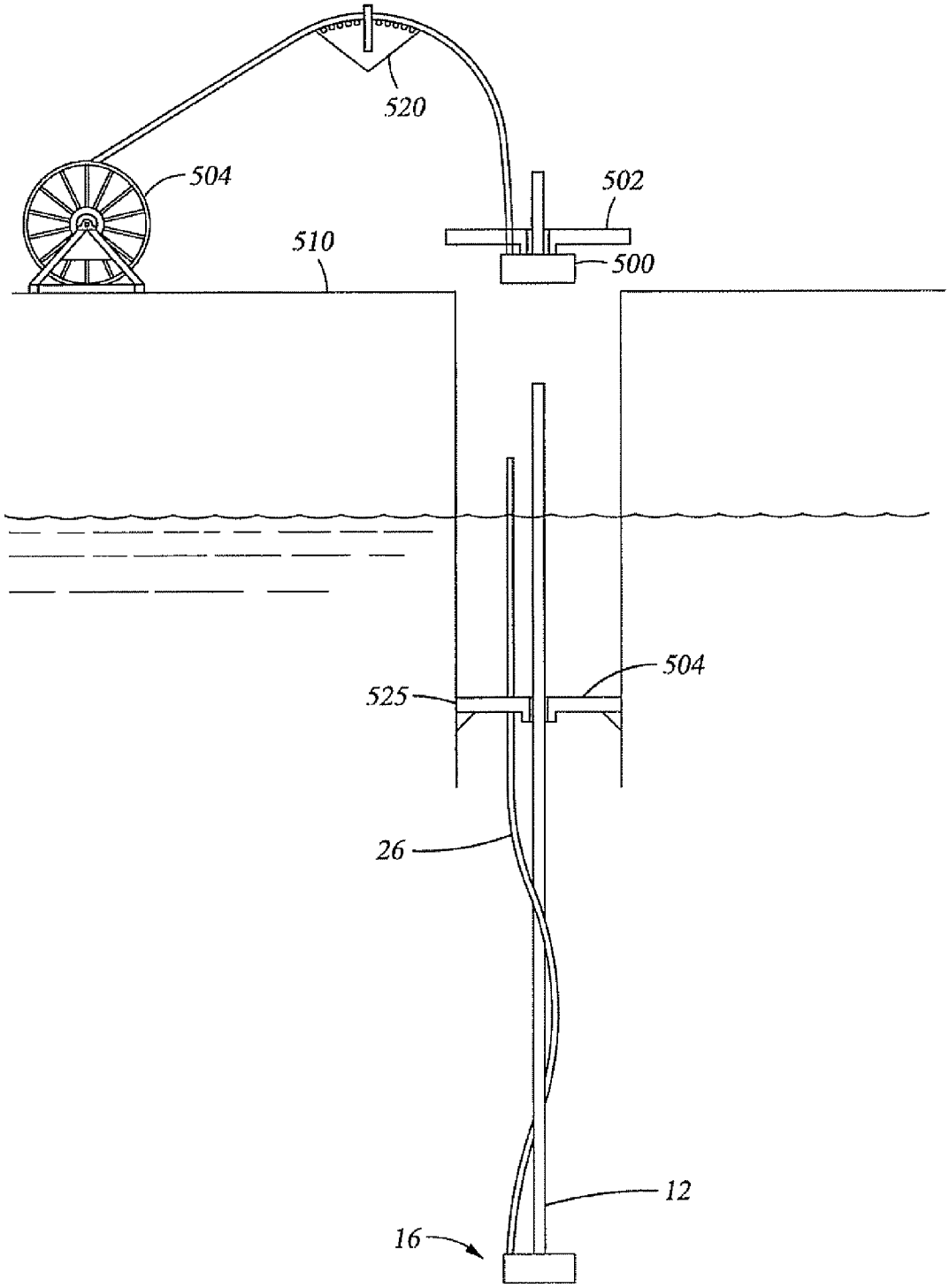
FIG. 5 is a partial schematic representation of a system for the installation of an umbilical and riser constructed in accordance with embodiments of the present invention.

Referring now to FIG. 5, a system and method of installation of an umbilical 26 with riser 12 to a tree 16 is seen. Tree connector 500 and guide sleeve 502 are mounted on deck 510 of floating platform 10 (FIG. 1). Umbilical 26 comprises a flexible, reel-held conduit that is supported by turndown sheave 520 and spooled on reel 504. Umbilical 26 is fed from reel 504 through turndown sheave 520, guide sleeve 502, and tree connector 500. From tree connector 500, umbilical 26 is fed through the keel 525 of floating platform 10 at guide sleeve 504. Through the use of an ROV, umbilical 26 is connected to subsea tree 16.

Figure 6:
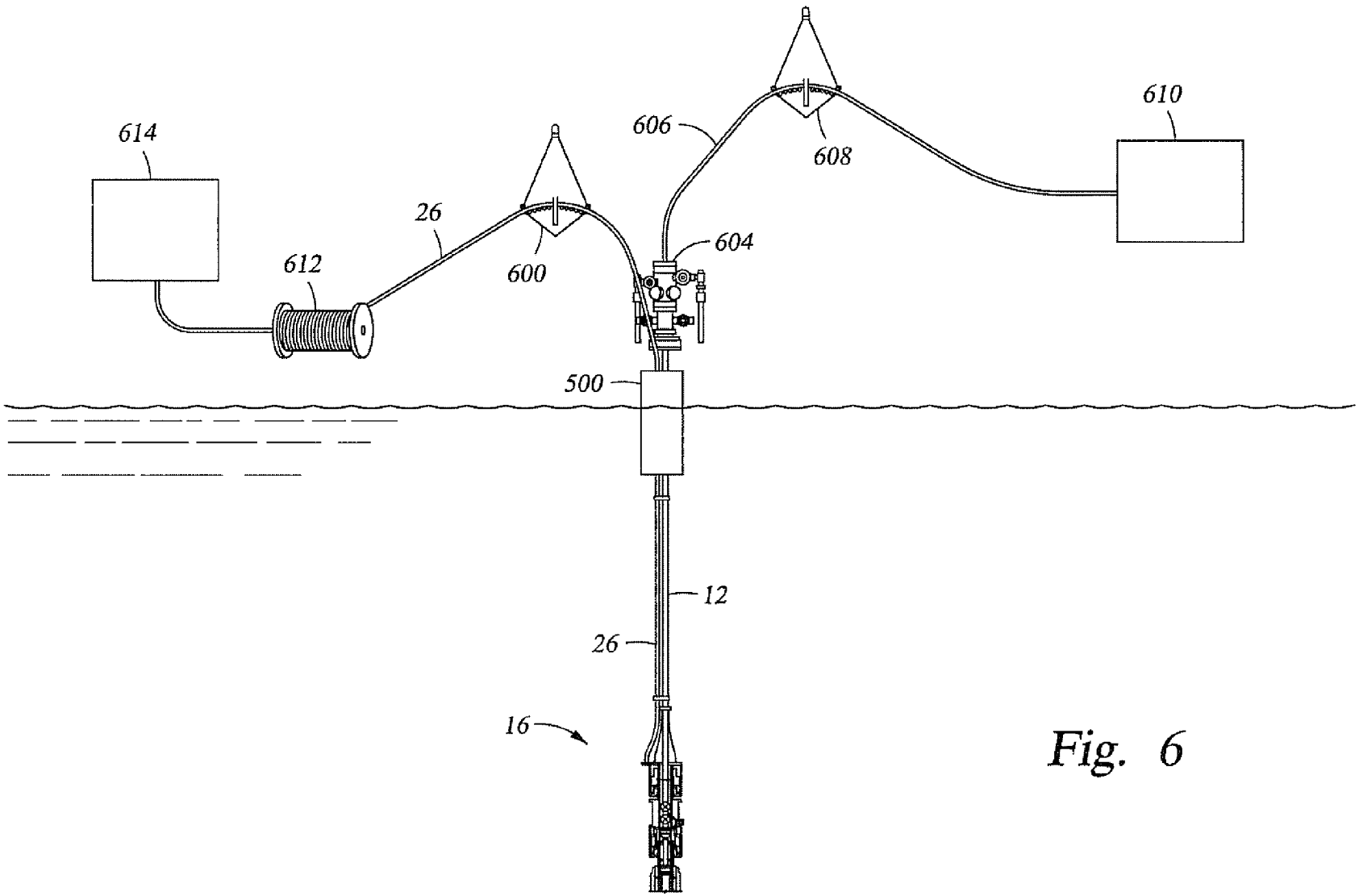
FIG. 6 is a partial schematic representation of a directly controlled subsea tree constructed in accordance with embodiments of the present invention.

Referring now to FIG. 6, a more detailed view of a direct control of subsea trees 16 is seen. Umbilical 26 (hydraulic or electro-hydraulic in an alternative embodiment) is supported by umbilical tensioner 600. Umbilical 26 is attached to hose reel 612 and control/hydraulic unit 614 as will be understood by those of skill in the art. Umbilical 26 passes through umbilical tensioner 600 and tree connector 500 to which surface tree 604 is attached. A flow line 606 is connected to the top of surface tree 604 and supported by flow line tensioner 608. Flow line 606 terminates in topside equipment 610 as well be understood by those of skill in the arts.

Figure 7:
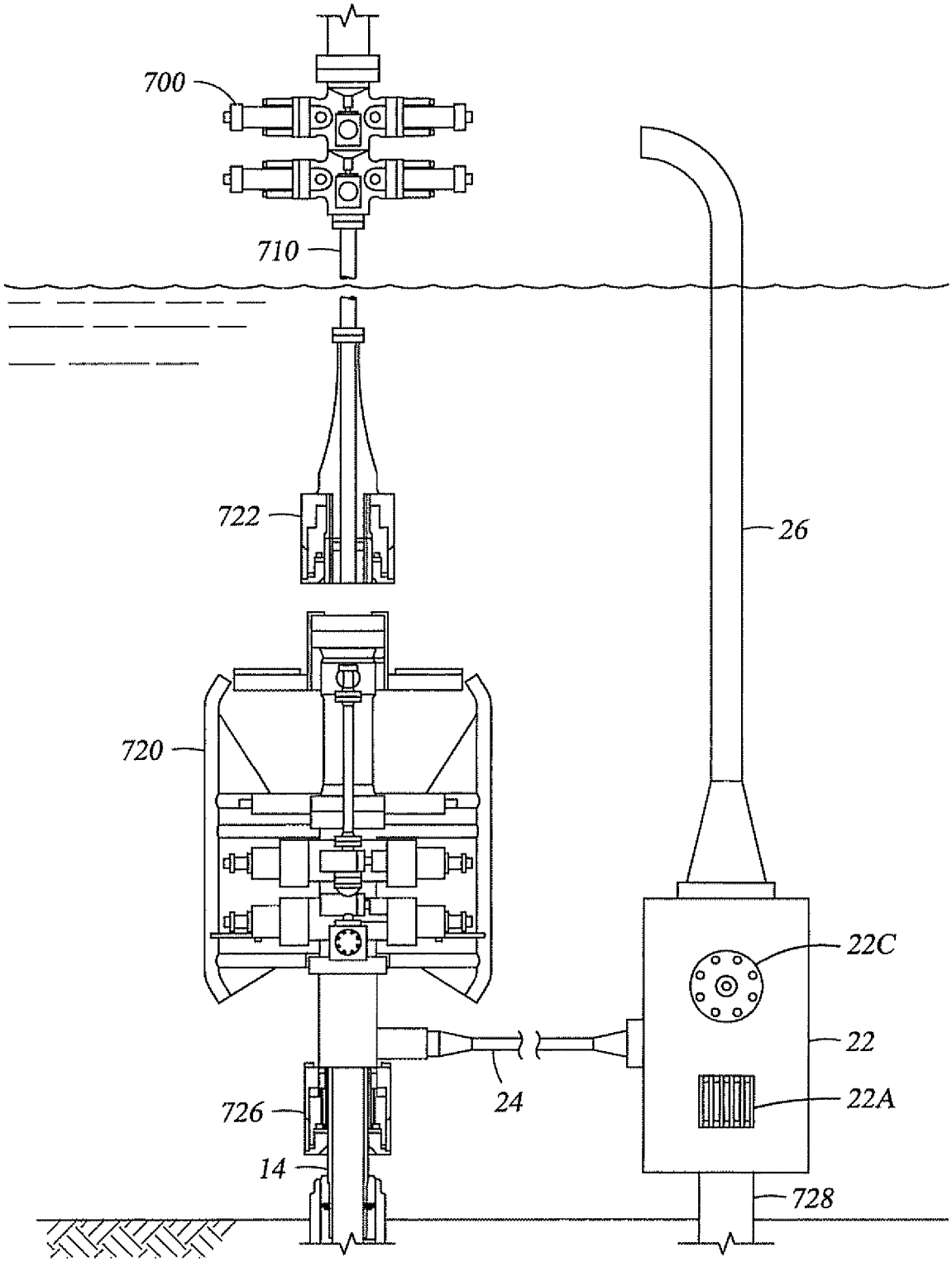
FIG. 7 is a partial schematic representation of a wellhead in a drilling configuration having a control system constructed in accordance with embodiments of the present invention.

Referring now to FIG. 7, a more detailed view of a well in a drilling mode being controlled by multiplex systems of the type seen in FIGS. 2 and 3 is illustrated. A pressure control device, such as surface blowout preventer 700, is connected to a drilling or work-over riser 710 that is, in turn, connected to a subsea blowout preventer 720 through tieback connector 722. Subsea blowout preventer 720 is mounted on wellhead 14 by tree connector 726. Surface blowout preventer 700 is mounted on floating platform 10 (FIG. 1) that can be positioned directly above wellhead 14 by moving the platform within its watch circle by the adjustment of the platform's mooring system.

Subsea blowout preventer 720 has various controls, as are known to those of skill in the art, which are coupled to subsea distribution unit 22 by flying leads 24. Subsea distribution unit 22 includes subsea control module 22C and subsea accumulator package 22A. In various embodiments, subsea accumulator package 22A includes a high-pressure accumulator, a low-pressure accumulator, and a "return" pressure accumulator. Subsea distribution unit 22 is mounted on subsea distribution unit docking platform 728 and is connected to floating platform 10 (FIG. 1) via umbilicals 26 (as described in reference to FIGS. 2 and 3).

Figure 8:
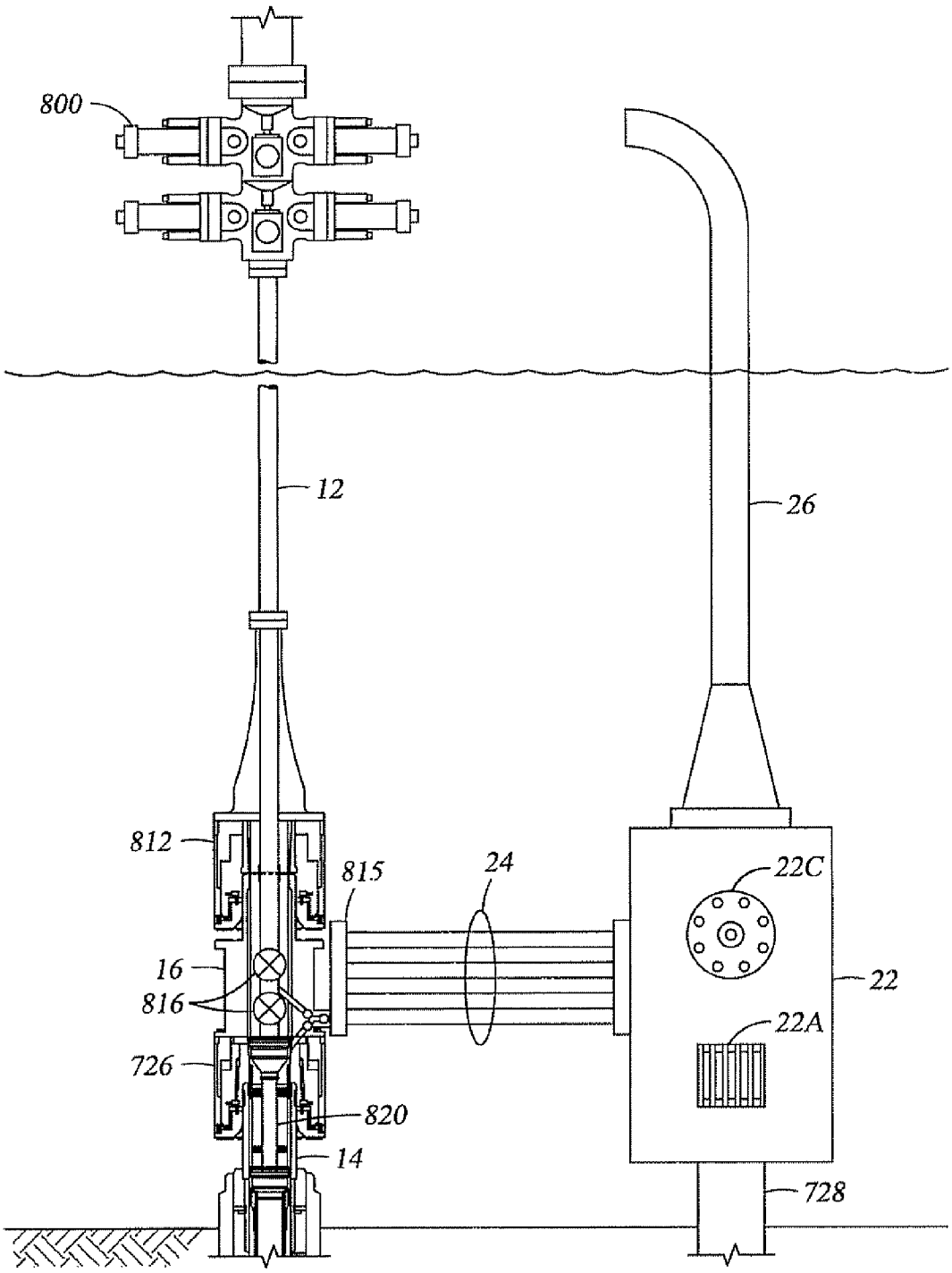
FIG. 8 is a partial schematic representation of a wellhead in a production configuration having a control system constructed in accordance with embodiments of the present invention.

Referring now to FIG. 8, the well of FIG. 7 is shown in a production mode being controlled by the same multiplex system. A pressure control device, such as surface tree 800, is connected to tubing riser 12, which is connected to riser connecter 812 and subsea tree 16 as is understood by those of skill in the art. Subsea tree 16 includes master valves 816 and annulus valves 818 for access and control of the annulus between tubing 820 of wellhead 14 and the other components of the wellhead. Control and instrumentation junction plate 825, which serves as a connector for subsea flying lead 24.

Figure 9:
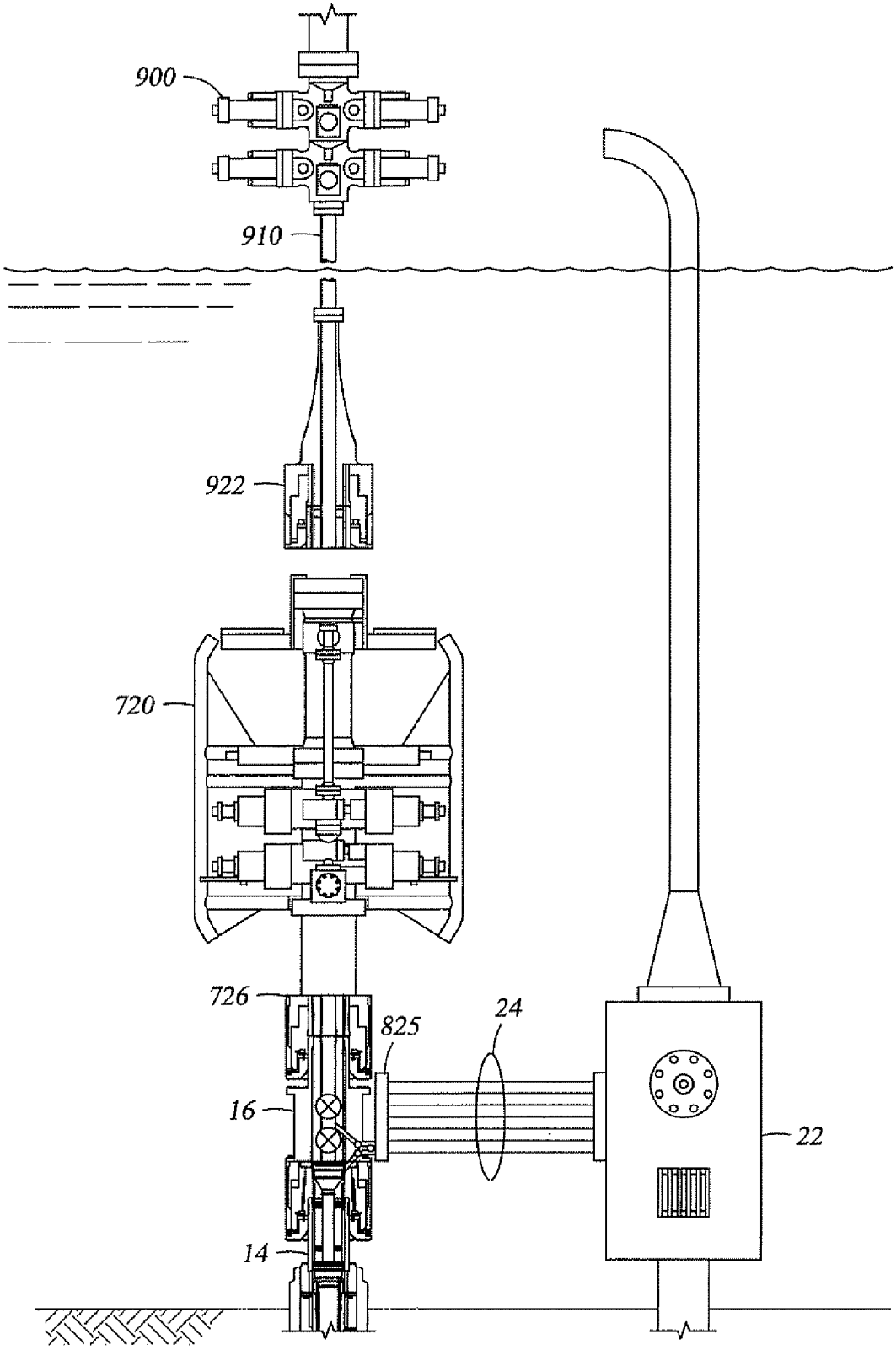
FIG. 9 is a partial schematic representation of a wellhead in a workover configuration having a control system constructed in accordance with embodiments of the present invention.

Referring now to FIG. 9, an example embodiment is shown with the well in a work-over configuration. A pressure control device, such as surface blowout preventer or tree 900, resides on floating platform 10 (FIG. 1), and work-over riser 910 is connected to tie-back connector 922. Subsea blowout preventer 720 is connected to subsea tree 16 via tree connector 726 and subsea flying lead umbilical 24 is connected to control and instrumentation junction plate 825 and subsea distribution unit 22. As in the drilling mode of FIG. 7, floating platform 10 (FIG. 1) that can be positioned directly above wellhead 14 by moving the platform within its watch circle by the adjustment of the platform's mooring system.

While a specialized subsea distribution unit 22 is useful in some embodiments for production, and a specialized subsea distribution unit 22 is useful in other example embodiments for drilling or work-over configurations, the examples seen in FIGS. 7-9 show a common type of subsea distribution unit 22 having similar components. This allows for efficiencies in that the control and distribution functions for drilling, work-over, and production, are provided in one unit on the sea floor that can interface with a variety of equipment, such as risers 710, 810, and 910, subsurface blowout preventer 720, and subsea tree 16. Likewise, subsea flying lead umbilical 24 may include all control lines for all three operational modes or any combination of two modes. Examples of the controls provided in various embodiments include: BOP control, connector lock/unlock, tree control, DSSV control, chemical injection, annulus monitoring, instrumentation communication, and others.

Figure 10:
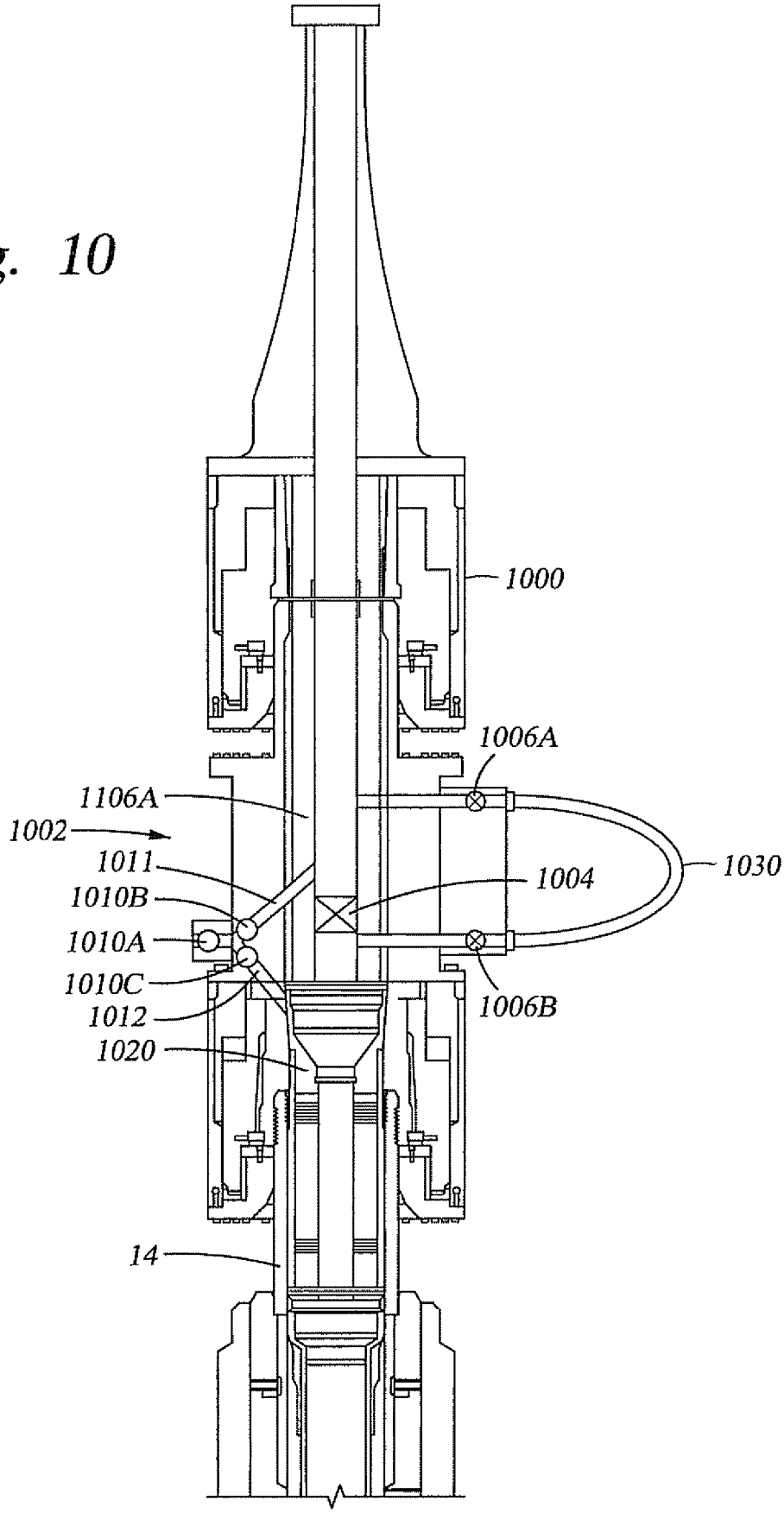
FIG. 10 is a partial sectional view of a subsea tree with an exterior production master valve.

Referring now to FIG. 10, an example embodiment of the subsea tree with an exterior production master valve is seen, in which riser connector 1000 attaches to subsea tree 1002 that includes sea plug 1004. Master valves 1006A and 1006B control access on either side of sea plug 1004. Annulus access valves 1010A, 1010B, and 1010C control access to the subsea tree annulus on each side of sea plug 1004. In various operational situations, pressure in an annulus can increase to an unacceptable level. In such cases, it is desirable both to monitor the annulus (e.g., through annulus valves 1010A-C), and/or to provide fluids (e.g., drilling mud or cement) into the annulus through valves 1010A-C. Likewise, should the annulus line attach to annulus access valve 1010A be insufficient to carry the desired fluid into the annulus (for example, in embodiments in which the annulus line is sized merely for monitoring), then master valves 1006A and 1006B are manipulated such that a fluid (e.g., cement) is pumped down through a riser (connected to riser connecter 1000) and into annulus access passage 1011. Annulus access valves 1010A-C are manipulated such that the fluid then passes through annulus access passage 1012 into annulus 1020. From the illustrated embodiment, and the above description, it will be understood by those of skill in the art how various other annulus control and access operations are performed through manipulation of master valves 1006A and B and annulus access valves 1010A-C.

Figure 11:
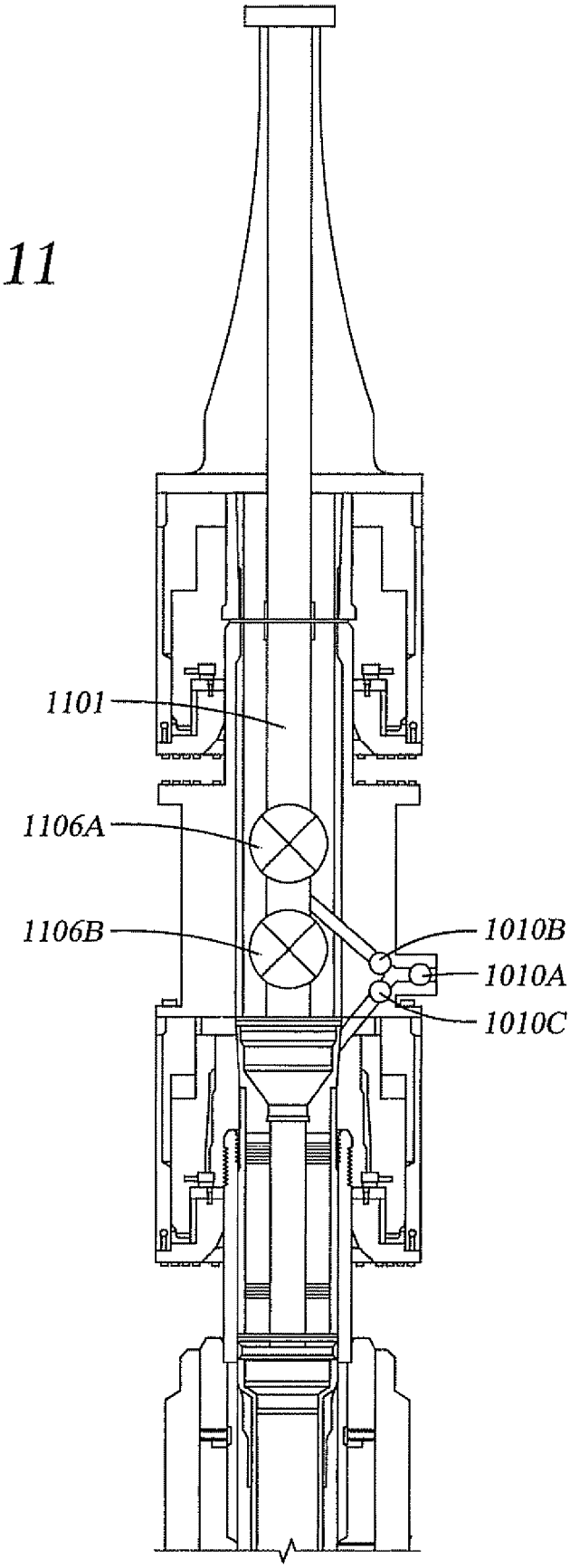
FIG. 11 is a partial sectional view of a subsea tree with integral valves.

Referring now to FIG. 11, an alternative embodiment of a subsea tree is seen in which the valves are integral with a spool piece. Rather than have master valves 1006A and 1006B controlling flow line access passage 1030 master valves 1106A and 1106B control the flow line 1101 directly.

Figure 12:
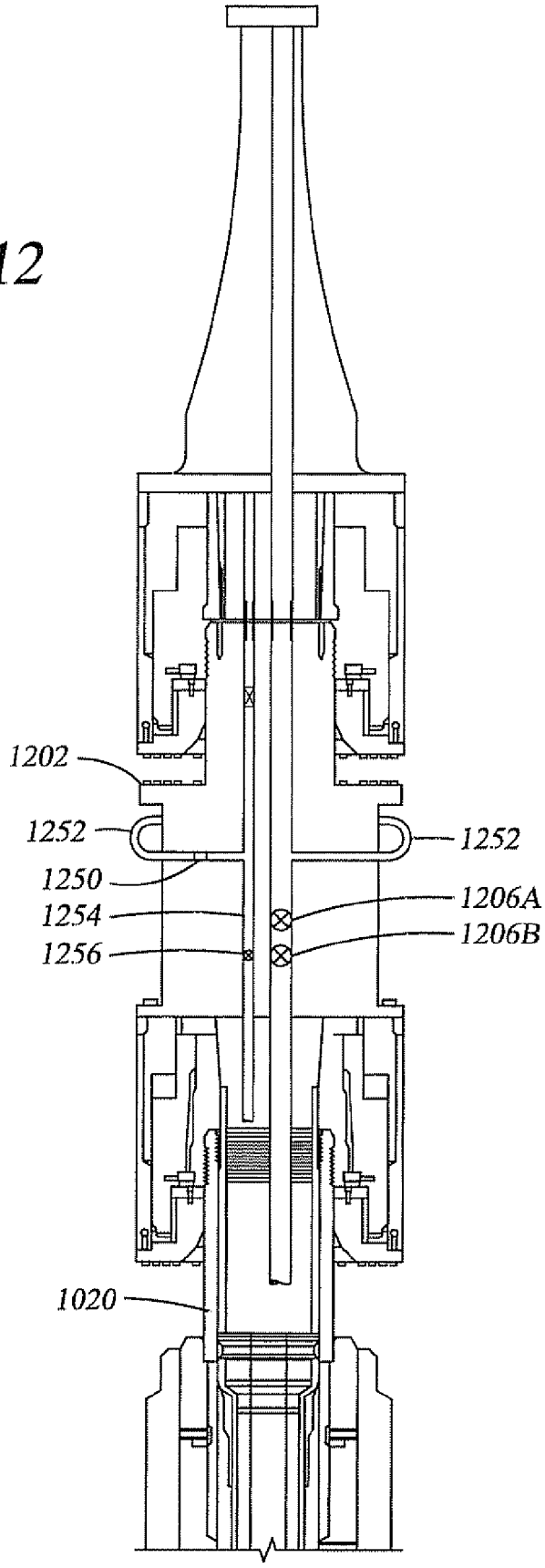
FIG. 12 is a partial sectional view of a subsea tree with vertical annulus and production strings.

Referring now to FIG. 12, still a further alternative embodiment is seen in which a subsea tree with a vertical annulus and production string is illustrated. Flow line 1201 is controlled by production master valves 1206A and 1206B housed within subsea tree 1202. Also within subsea tree 1202 is cross-over valve 1250 which controls flow and a cross-over access passage 1252 that, in turn, controls communication between annulus access passage 1254 and flow line 1201. Annulus master valve 1256 is provided an annulus access passage 1254 for providing access to annulus 1020.

Figure 13:
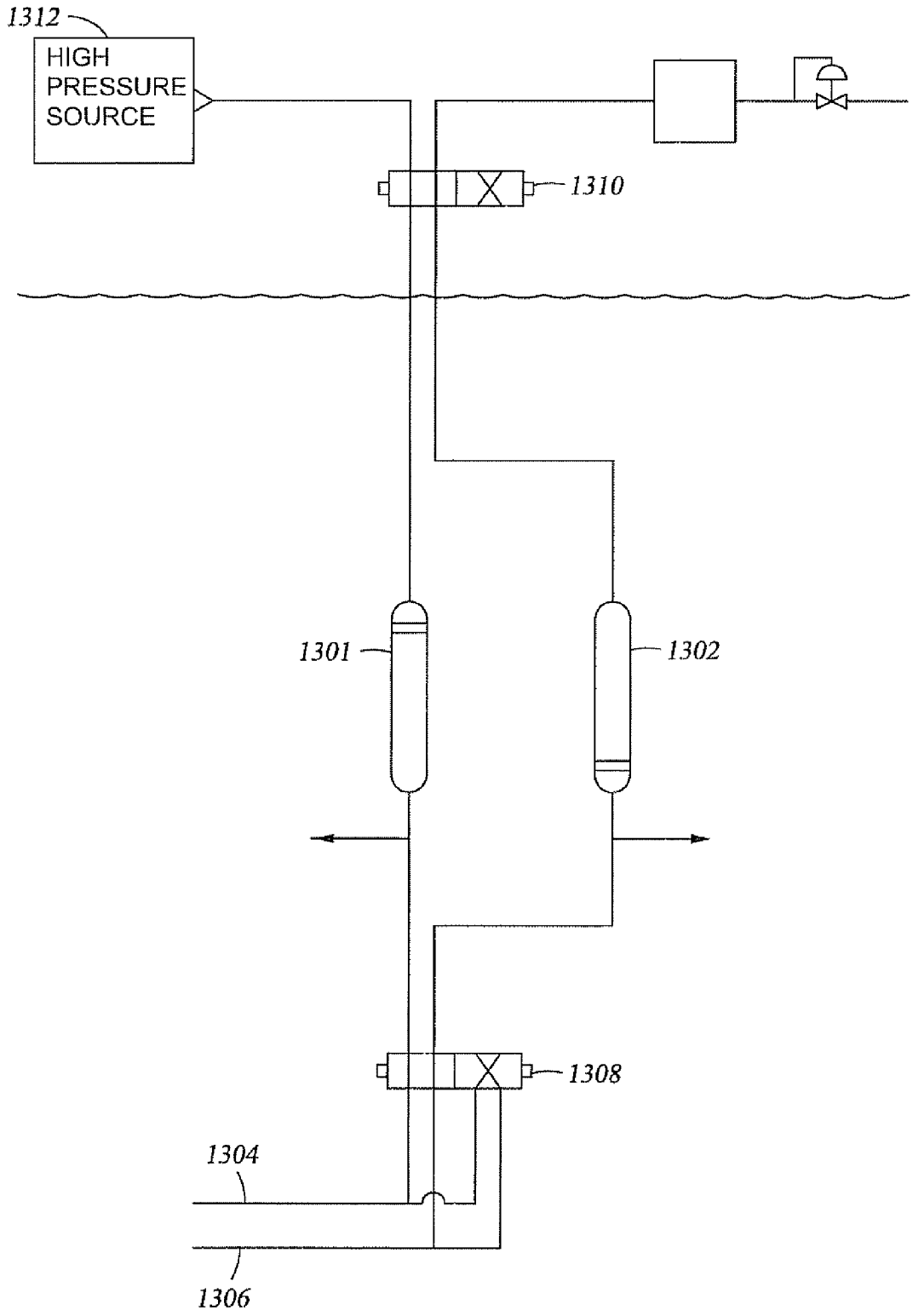
FIG. 13 is a partial schematic view of a subsea hydraulic accumulator package.

Referring now to FIG. 13, a hydraulic accumulator package is seen in which accumulator 1301 and accumulator 1302 are in connection with hydraulic supply line 1304 and hydraulic return line 1306 through hydraulic control valve 1308 (located on the bottom). Accumulators 1301 and 1302 are also in communication with another hydraulic control valve 1310, which is located on the topside. As seen, 1308 and 1310 are two-position, single-throw valves. Other valves will occur to those of ordinary skill in the art as alternative examples. Supply pressure source 1312 is connected through valve 1310 to accumulator 1301 and through valve 1308 to hydraulic supply line 1304, which is connected to the various well-control systems described above. The use of subsea accumulators as illustrated provides for multiple efficiencies in the hydraulic operations.

Figure 14:
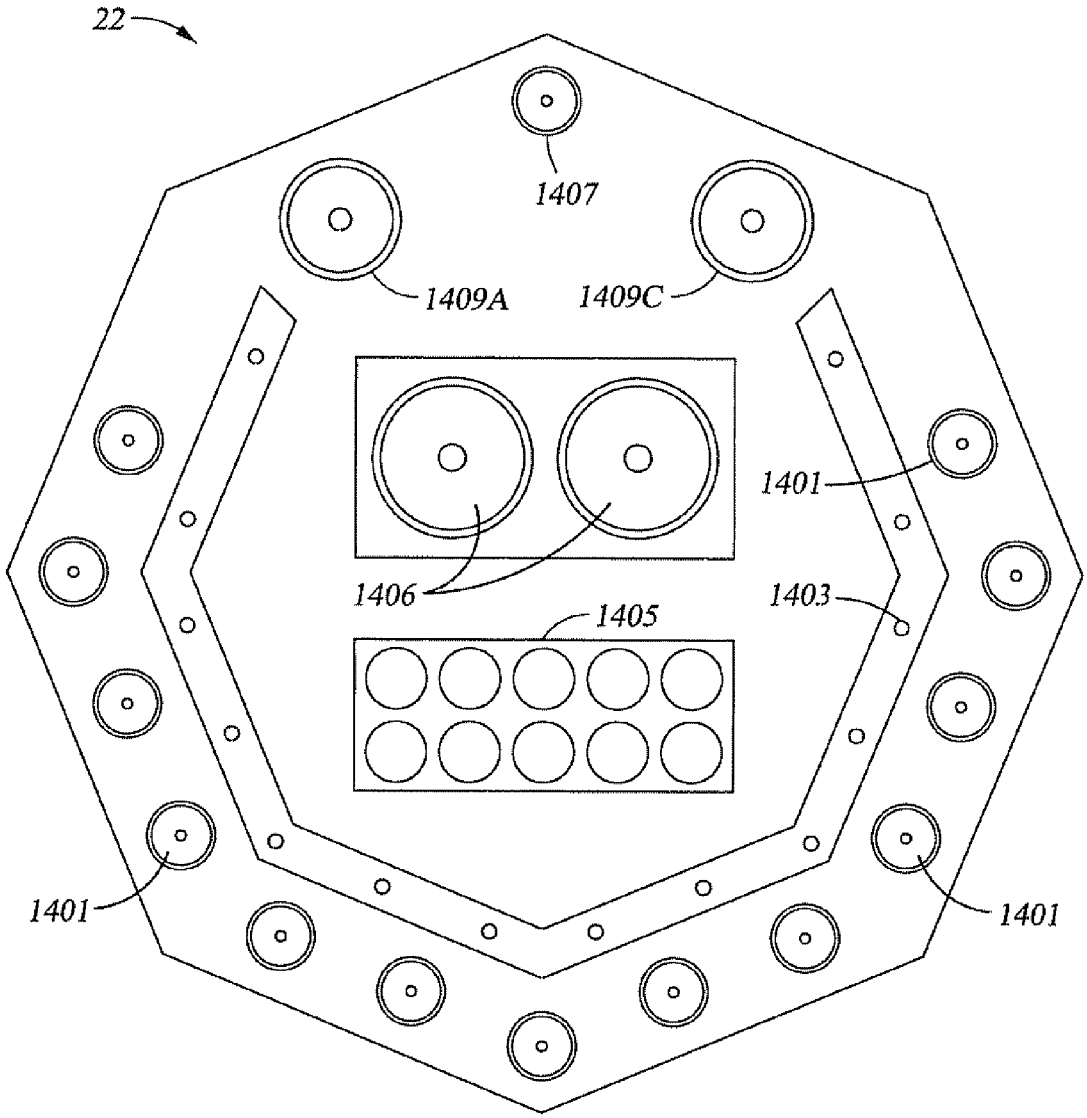
FIG. 14 is a partial schematic view of subsea distribution, control, and monitoring station.

Referring now to FIG. 14, an example of DCM station 22 from FIG. 1 is seen. DCM station 22 comprises hydraulic connectors 1401, electrical connectors 1403, accumulator bank 1405, subsea control modules 1406, electro-hydraulic umbilical connector 1407, and injection umbilical connectors 1409A-B. Hydraulic connectors 1401 and electrical connectors 1403 provide termination connection points for a plurality of hydraulic and electric flying leads that are connected to individual wellheads. Accumulator bank 1405 includes a plurality of hydraulic accumulators that store a predetermined volume of hydraulic fluid at a selected pressure. There may be fewer accumulators than there are connectors for flying leads because not all wells will require hydraulic circuit control with significant accumulators at the same time.

Subsea control modules 1406 house the various electrical circuits and control systems that connect to electrical connectors 1403. An electrical-hydraulic umbilical connection 1407 connects to an electro-hydraulic flying lead that provides electrical signal and hydraulic communication with a floating platform. Likewise, injection connectors 1409A and 1409B are provided for the connections needed for the chemical injection flying leads.

Thus, DCM station 22, through control modules 1406 and the multiplexers and valve-selectable manifolds disposed within the station, provides electrical and fluid communication between a plurality of distributed wells and a single floating installation so as to control equipment disposed on the wellheads as well as fluid injection capabilities.

The above description is given by way of example only and not intended to limit the scope of the invention as claimed. Other examples will occur to those of skill in the art, which are within the scope of the invention.

What is claimed is:

1. A system comprising:

a surface installation in position above a plurality of subsea wells;

a mooring system that maintains said surface installation within a watch circle, wherein each of the plurality of subsea wells are disposed within the watch circle;

a plurality of flowlines, wherein each flowline directly couples one of the plurality of subsea wells to said surface installation;

a distribution body disposed on the seafloor;

a control station disposed on said surface installation and operable to provide electrical signals to said distribution body via an electrical umbilical disposed between said surface installation and said distribution body;

a hydraulic power unit disposed on said surface installation and operable to provide pressurized hydraulic fluid to said distribution body via a hydraulic umbilical disposed between said surface installation and said distribution body;

an injection unit disposed on said surface installation and operable to provide an injection fluid to said distribution body via an injection umbilical disposed between said surface installation and said distribution body;

a first wellhead component disposed on one of said subsea wells and coupled to said distribution body via one or more flying leads that provide electrical, hydraulic, and fluid communication between said distribution body and said first wellhead component; and a second wellhead component disposed on another one of said subsea wells and coupled to said distribution body via one or more flying leads that provide electrical, hydraulic, and fluid communication between said distribution body and said second wellhead component, wherein said control station is operable to provide control functions to said first and second wellhead components during drilling, workover, and production activities.

2. A subsea control system as in claim 1, wherein said distribution body comprises a hydraulic manifold selectable to provide, in a first state, hydraulic communication between said first wellhead component and said hydraulic power unit and to provide, in a second state, hydraulic communication between said second wellhead component and said hydraulic power unit.

3. A subsea control system as in claim 2, further comprising an accumulator bank disposed on said distribution body and in fluid communication with said hydraulic power unit and said hydraulic manifold.

4. A subsea control system as in claim 1, wherein said distribution body comprises an electrical multiplexer selectable to provide, in a first state, electrical communication between said first wellhead component and said control station and to provide, in a second state, electrical communication between said second wellhead component and said control station.

5. A subsea control system as in claim 1, wherein said distribution body comprises a first direct electrical connection between said first wellhead component and said control station and a second direct electrical connection between the second wellhead component and said control station.

6. A subsea control system as in claim 1, wherein said distribution body comprises an injection manifold selectable to provide, in a first state, fluid communication between said first wellhead component and said injection unit and to provide, in a second state, fluid communication between said second wellhead component and said injection unit.

7. A subsea control system as in claim 1 further comprising:

a monitoring input located in said distribution body;

a first monitoring output disposed on said first wellhead component; and a second monitoring output disposed on said second wellhead component;

wherein said monitoring input is selectably connectable between the first monitoring output and the second monitoring output.

8. The subsea control system as in claim 7, wherein said monitoring input is coupled to said control station.

9. A subsea control system for control of a first subsea well and a second subsea well, the control system comprising:

a flowline directly disposed between each of the first and second subsea wells and a surface installation having a watch circle, wherein both the first and second subsea wells are disposed within the watch circle;

a distribution body disposed on the seafloor;

a control distributor disposed on said distribution body and in communication with a control station at the surface, wherein said control distributor comprises production function controls, drilling function controls, a first control output, and a second control output;

a first wellhead component coupled to the first subsea well and in communication with the first control output; and a second wellhead component coupled to the second subsea well and in communication with the second control output;

wherein said control distributor comprises an injection manifold selectable to provide, in a first state, fluid communication between said first wellhead component and the control station and to provide, in a second state, fluid communication between said second wellhead component and the control station.

10. A subsea control system as in claim 9, wherein said control distributor comprises an hydraulic manifold selectable to provide, in a first state, hydraulic communication between said first wellhead component and the control station and to provide, in a second state, hydraulic communication between said second wellhead component and the control station.

11. A subsea control system as in claim 10, further comprising an accumulator bank disposed on said distribution body and in fluid communication with said hydraulic power unit and said hydraulic manifold.

12. A subsea control system as in claim 9, wherein said distribution body comprises an electrical multiplexer selectable to provide, in a first state, electrical communication between said first wellhead component and the control station and to provide, in a second state, electrical communication between said second wellhead component and the control station.

13. A subsea control system as in claim 9, wherein said distribution body comprises a first direct electrical connection between said first wellhead component and the control station and a second direct electrical connection between the second wellhead component and the control station.

14. A subsea control system as in claim 9, wherein the injection manifold is a chemical injection manifold.

15. A subsea control system as in claim 9, further comprising:

a monitoring input located in said distribution body;

a first monitoring output disposed on said first wellhead component; and a second monitoring output disposed on said second wellhead component;

wherein said monitoring input is selectably connectable between the first monitoring output and the second monitoring output.

16. The subsea control system as in claim 15, wherein said monitoring input is coupled to said control station.

17. A system comprising:

a surface installation having a position maintained within a watch circle by a mooring system;

a plurality of subsea wells disposed within the watch circle such that said surface installation can achieve direct vertical access to each of said wells;

a first wellhead component disposed on one of said subsea wells;

a second wellhead component disposed on another of said subsea wells;

a distribution body disposed on the seafloor and coupled to both the first and second wellhead components by flying leads that provide electric and hydraulic communication between said distribution body and the wellhead components;

a control system disposed on said surface installation and operable to provide electrical and hydraulic signals to said distribution body via at least one umbilical disposed between said surface installation and said distribution body;

a substantially vertical riser extending from said surface installation to the first wellhead component; and a pressure control device coupled to said riser and disposed on said surface installation.

18. The system of claim 17, wherein said first wellhead component is a subsea blowout preventer and said pressure control device is a surface blowout preventer.

19. The system of claim 17, wherein said first wellhead component is a subsea tree and said pressure control device is a surface tree.

20. The system of claim 17, further comprising an injection unit disposed on said surface installation and operable to provide an injection fluid to said distribution body via an injection umbilical disposed between said surface installation and said distribution body, wherein said distribution body is coupled to both said first and second wellhead components via injection flying leads that provide fluid communication between said wellhead components and said distribution body.

* * * * *